United States Patent [19]

Cohn

[11] 4,187,862

[45] Feb. 12, 1980

[54] TREATMENT OF CIGARETTE PAPER

[76] Inventor: Charles C. Cohn, 123 S. New Hampshire Ave., Atlantic City, N.J. 08401

[21] Appl. No.: 925,224

[22] Filed: Jul. 17, 1978

[51] Int. Cl.[2] ..... A24D 1/00; A24D 1/10; A24D 1/12

[52] U.S. Cl. ..... 131/15 R

[58] Field of Search ..... 131/4 R, 4 B, 4 A, 15 R, 131/15 C, 15 A, 15 B, 8 R, 4, 8 A

[56] References Cited

U.S. PATENT DOCUMENTS

| | | | |
|---|---|---|---|
| 1,905,416 | 1/1831 | Low | 131/8 R |
| 1,996,002 | 3/1935 | Seaman | 131/8 R |
| 2,028,552 | 8/1934 | Low | 131/8 R |
| 2,049,320 | 7/1936 | Ruben | 131/11 |
| 2,985,175 | 5/1961 | Rich | 131/8 R |
| 3,030,963 | 4/1962 | Cohn | 131/4 |
| 3,220,418 | 11/1965 | Cohn | 131/4 |
| 4,044,778 | 8/1977 | Cohn | 131/4 A |

*Primary Examiner*—V. Millin
*Attorney, Agent, or Firm*—George A. Smith, Jr.

[57] ABSTRACT

Cigarette paper is treated by one or the other of two alternative processes. The first alternative process is characterized by the step of coating between 40 and 100% of the surface area of the paper with an aqueous alkali metal silicate solution, the $SiO_2$ concentration of which ranges from between 12 and 16% for 40% coverage to between 7 and 15% for full coverage. The second alternative process is characterized by two sequential uniform coatings of an aqueous alkali metal silicate solution, the $SiO_2$ concentrations in each solution ranging from 1.7% to 6%.

3 Claims, 8 Drawing Figures

TREATMENT OF CIGARETTE PAPER

BRIEF SUMMARY OF THE INVENTION

This invention relates to a process for treating cigarette paper for the improvement of fire safety, for reducing the offensiveness of the cigarette to non-smokers, and for reducing the health hazard to the smoker. It is particularly directed to the treatment of cigarette paper by processes which impart to the paper a coating containing silica ($SiO_2$) as the principal fire retardant.

Various processes for the treatment of cigarette paper using silicates and the like have been proposed.

For example, Albert M. Low's U.S. Pat. No. 1,905,416, dated Apr. 25, 1933, describes a cigarette in which the cigarette paper is treated with a "very dilute" solution of sodium silicate. One object of the treatment is to cause the ash of the cigarette wrapper to fuse or sinter in such a manner as to form a sheath about the tobacco ash. Another objective is to provide a self-extinguishing cigarette. With respect to the second objective, the theory of operation is that the silicate treatment renders the paper more or less impermeable. This in turn is said to cause the gaseous combustion products of the tobacco to be largely retained within the enveloping sheath so that when the entrance of air induced by the suction of smoking is discontinued, the combustion products extinguish the cigarette.

Low's later U.S. Pat. No. 2,028,552, issued Jan. 21, 1936 describes a cigarette treated both with silicate and with potassium nitrate. The purpose of the nitrate is to prevent the smothering action of the treatment in the earlier Low patent, while at the same time retaining the sintering effect of the silicate in order to prevent the ashes from falling off the cigarette while hot. In this patent, Low refers to a silicate having a gravity of about 3½ degrees Baume'. Assuming a silicate having an $SiO_2$:-$Na_2O$ ratio of 3.2:1, a Baume' gravity of 3½ translates to a $SiO_2$ content in the vicinity of 2.48% by weight.

Seaman U.S. Pat. No. 1,996,002, issued Mar. 26, 1935, describes a cigarette having a fire retardant band at or near the end near the smoker's mouth produced by the treatment of the paper with a fire retardant such as sodium silicate. The cigarette smokes normally until it burns down to the fire retardant band, and then extinguishes.

In Rubin U.S. Pat. No. 2,049,320, dated July 28, 1936, a self-extinguishing cigarette is described in which the wrapper is treated with a combination of silicate, glycerin, starch and talc, the silicate comprising 49% of the combination. The treatment may be applied as a single step, or alternatively in two steps in which the first step is the impregnation of the cigarette wrapper with the silicate in a concentration such as not to soak the wrapper, and in which the other substances of the combination are applied in a separate step.

My own U.S. Pat. No. 3,030,963, dated Apr. 24, 1962 describes a cigarette in which dots or helical bands of silicate are applied to the exterior of the wrapper by means of a solution containing at least 14.5% $SiO_2$. The dots or helical band foam when they are sufficiently heated by the burning part of the cigarette, and produce a supporting surface underlying the cigarette, keeping the burning part raised above the surface on which the cigarette is resting. This patent describes a cigarette which is not self-extinguishing.

My U.S. Pat. No. 3,220,418, issued Nov. 30, 1965, describes a cigarette having a relatively non-combustible sheath with silicate deposits located between the sheath and the combustible wrapper of the cigarette. These deposits are applied by the use of a solution containing at least 14.5% silicate, and having a sodium to silicate ratio of approximately 1:2.

Rich patent 2,985,175, date May 23, 1961 describes an ash-reinforcing binder for cigars utilizing stripes of silicate located inside the cigar wrapper.

My U.S. Pat. No. 4,044,778, which issued on Aug. 30, 1977 describes a self-extinguishing cigarette having lines covering about 40 to 84% of the cigarette wrapper, the lines being applied by the application of a silicate solution containing about 17 to 20% by weight of $SiO_2$. My patent also discloses the coating of the entire paper with a silicate solution containing between about 5.7 to 10.2% $SiO_2$, followed by the application of lines of silicate by means of a solution containing between about 19.5 and 22.5% of $SiO_2$.

My copending application Ser. No. 778,665, filed Mar. 17, 1977 now Pat. No. 4,146,040 describes a fire resistant cigarette wherein the paper is coated with a silicate solution in a first step, and thereafter treated with a pH-lowering material in order to eliminate the alkaline taste of the smoke.

The principal object of this invention is to provide a cigarette having sufficient fire resistance to prevent fires from occurring when the lit cigarette is dropped upon a mattress, sofa or like piece of furniture, and which, at the same time, has an acceptable appearance, a low manufacturing cost, and a taste unimpaired by the alkalinity of the silicate used in the treatment.

It is also an object of the invention to effect a substantial reduction in the amount of smoke produced by a cigarette while smoldering, i.e. between puffs, thereby reducing the offensiveness of the cigarette to non-smokers, and at the same time reducing the health hazards to the smoker from the tars, nicotine and gases in the smoke produced during smoldering.

Still another object of the invention is to increase the number of available puffs in a cigarette having a given quantity of tobacco.

None of the prior art patents set forth above satisfy the objective of this invention, nor do my U.S. Pat. No. 4,044,778 and may application serial number 778,665 now U.S. Pat. No. 4,146,040. Cigarettes produced in accordance with the Low patents have a uniform silicate coating, but are unable to prevent fires when dropped upon mattresses. Cigarettes made in accordance with Seaman likewise do not pass the mattress tests, primarily because the coating is non-uniform on the cigarette paper. The coating described in Rubin is uniform, and potentially capable of preventing mattress ignition, but the cost of applying the coating is relatively high, and the taste of the smoke is impaired by the high concentration of silicate. The cigarette in accordance with my U.S. Pat. No. 3.030,963 does not reliably prevent ignition of mattresses, has protuberances which detract from its appearance, and is also subject to various manufacturing difficulties. Likewise, the cigarette described in my U.S. Pat. No. 3,220,418 has a somewhat unusual appearance because of the outer sheath, and is relatively costly to manufacture. The cigar of Rich U.S. Pat. No. 2,985,175 does not pass the mattress tests.

The cigarette made in accordance with my patent 4,044,778 is capable of passing the mattress tests, but produces smoke having an alkaline taste, and the high concentration of silicate in the wrapper produces an appearance which in some cases is unacceptable. Cigarettes treated in accordance with my application Ser. No. 778,665 produce smoke having an acceptable taste, but are costly to manufacture because of the need for distinct steps of applying silicate and pH-lowering material.

None of these prior cigarettes produce a significantly reduced quantity of smoke between puffs.

In summary, in those instances wherein a uniform coating is applied in the prior art, the coating is either too low in $SiO_2$ (as in Low) to produce adequate fire resistance, or, if sufficiently high (as in Rubin) the cost of manufacture is high, and the smoke is impaired by the alkalinity of the silicate. In the case of non-uniform coatings, the cigarettes either do not pass the fire resistance test, or their taste and appearance are impaired, or, as in the case of my application, a completely different process is involved, and the cost of manufacture is relatively high.

While the danger of mattress ignition by burning cigarettes has been a matter of great public concern for years, and a substantial amount of time and effort have been expended by various researchers looking for a marketable cigarette capable of avoiding mattress ignition, no one, to my knowledge, has perceived the simple solution which is the subject matter of the present invention.

In brief, the invention contemplates the treatment of cigarette paper by one or the other of two alternative processes. The first of the alternative processes comprises the steps of soaking at least part of the surface of the paper of the cigarette with an aqueous alkali metal silicate solution to impart a coating to the paper, allowing the coated paper to dry, and forming the paper into a cylinder to produce a cigarette wrapper, wherein the $SiO_2$ concentration by weight in the coating, and the coated area of the surface in any selected three millimeter long section of the cylinder are within the boundaries of an area defined by straight lines joining the following points (the first of each pair of numbers being the percentage ratio of the coated area to the total area, and the second number being the percentage of $SiO_2$ in the silicate solution by weight): 100, 6; 100 14.5; 52, 16; 40, 16; 40, 12.2; 50, 10.5; and 90, 6.2.

In accordance with the other of the two alternative processes, cigarette paper is treated by the sequential steps of soaking substantially the entire surface of the paper with an aqueous alkali metal silicate solution to impart a first coating, allowing the coated paper to dry, and a second step of soaking substantially the entire surface of the paper with an aqueous alkali metal silicate solution to produce a second coating. The concentrations of $SiO_2$ by weight in the respective coating steps are within the boundaries of a triangle, the corners of which are defined by the following points (the first number of each pair being the percentage of $SiO_2$ by weight in the first coating step, and the second number of each pair being the percentage of $SiO_2$ by weight in the solution of the second coating step): 6, 1.7; 6, 6; and 1.7, 6.

Treatment in accordance with either of the foregoing processes imparts a high degree of fire resistance to the cigarette at a relatively low manufacturing cost. At the same time, the treatment maintains an acceptable appearance, satisfactory burning characteristics, improved ash retention, normal smoke volume, taste and draw characteristics during puffing, reduced quantities of smoke between puffs, and an increased number of puffs for a given quantity of tobacco.

Various objects and advantages of the invention other than those specifically mentioned above will be apparent from the following detailed description.

DETAILED DESCRIPTION

Figure 1:
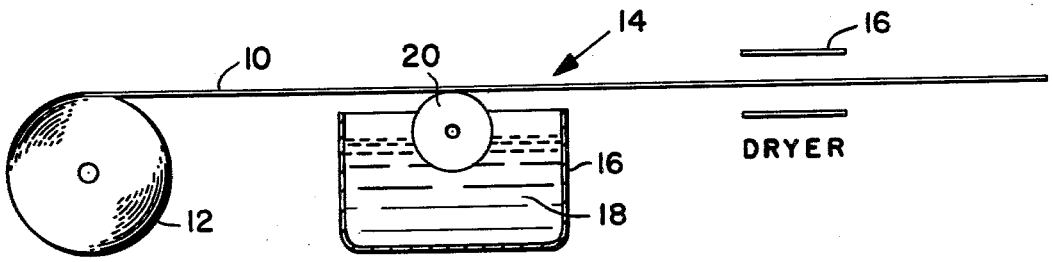
FIG. 1 is a schematic diagram of an apparatus for applying a silicate coating to cigarette paper in accordance with one of the two alternative processes of the invention.

The coating of cigarette paper by a process comprising only a single coating step, is carried out by an apparatus such as that shown in FIG. 1, wherein a sheet 10 of cigarette paper is fed from a roll 12 to a coater 14 and from there to a dryer 16. The coater comprises a vessel 16 containing a liquid bath 18 consisting of an aqueous solution of alkali metal silicate. Silicates are manufactured in various ratios of alkali metal oxide (e.g. $Na_2O$) to silica ($SiO_2$), and the particular ratio is unimportant so far as fire resistance is concerned. A typical sodium silicate which can be used is type "O" silicate, manufactured by PQ Chemicals, Inc., having a ratio of 1:3.2. The amount of silica in the solution, however, does affect the fire resistance. Bath 18, when used to apply a uniform coating should have an $SiO_2$ concentration between about 6% and 14.5% by weight. A roller 20 is provided at the surface of the bath to transfer a measured quantity of the liquid to the lower side of the paper. The roller is preferably driven so that its peripheral speed is near the linear speed of the paper. The roller can be made of any one of a wide variety of materials such as porcelain or aluminum. The amount of silicate applied to the paper is determined in part by the extent to which the roller is wettable by the particular silicate solution used, and also by the speed at which the paper is fed past the roller. These factors, and particularly the speed are adjusted so that the area of the paper to which the silicate is applied is soaked, i.e. a sufficient quantity of silicate solution is applied to penetrate the paper and thoroughly moisten the side of the paper opposite the roller. Preferably the roller speed is adjusted so that the quantity of solution applied to the paper is not appreciably more than is necessary to moisten the opposite side of the paper.

Dryer 16, which is shown diagrammatically, can be any sort of dryer capable of removing moisture from the paper. Preferably, however, a hot air dryer is used.

While the roll 12 of cigarette paper can be only as wide axially as the length of a typical cigarette, it is preferably at least several feet long for efficiency in treatment of the paper. The paper is then slit to the desired length following drying.

Figure 2:
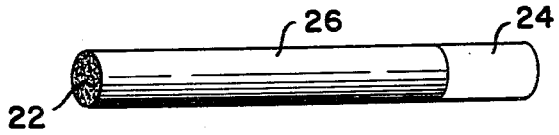
FIG. 2 is a perspective view of a cigarette having a uniform silicate coating in accordance with the invention.

A typical cigarette, the paper of which is treated by the apparatus of FIG. 1, is shown in FIG. 2. This cigarette comprises a charge 22 of tobacco, a filter covering 24, and a cylinder 26 of treated cigarette paper. The silicate coating can be either on the inside, i.e. next to the tobacco, or on the outside, or both on the inside and outside if suitable modifications are made in the treating apparatus. The coating step carried out in accordance with FIG. 1 stiffens the cigarette paper somewhat, but does not otherwise appreciably alter its physical appearance. The burning characteristics of the cigarette, however, are materially changed. In particular, the cigarette does pass the fire resistance test, and at the same time is capable of smoldering for at least one minute, thereby assuring satisfactory smoking.

Figure 4:
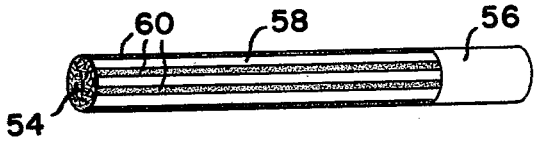
FIG. 4 is a perspective view of a cigarette having a partial silicate coating in accordance with the invention.

The apparatus of FIG. 1 can be modified, by incorporating axially aligned grooves in the outer surface of roller 20, to produce a cigarette paper having only part of its outer surface coated with silicate. A cigarette having paper coated in this manner is shown in FIG. 4. It comprises a charge 54 of tobacco, a filter covering 56, and a cylinder of cigarette paper 58 having multiple longitudinal stripes 60 extending along its length. Here the wetting characteristics of the roller are preferably chosen so that the quantity of silicate solution applied to the paper along the longitudinal stripes is just sufficient to soak the paper. The wetting characteristics of the roller are determined largely by the material from which the roller is made. The peripheral speed of the roller, in the case of a partial coating, of course, should be equivalent to the linear speed of the paper.

For the best results in the case of a partial coating utilizing relatively low silicate concentrations or relatively low percentages of area coverage, a minimum number of lines should be applied, and I prefer to use either one or two lines. A typical cigarette having two lines of silicate coating 62 and 64 is shown in FIGS. 7 and 8.

Figure 5:
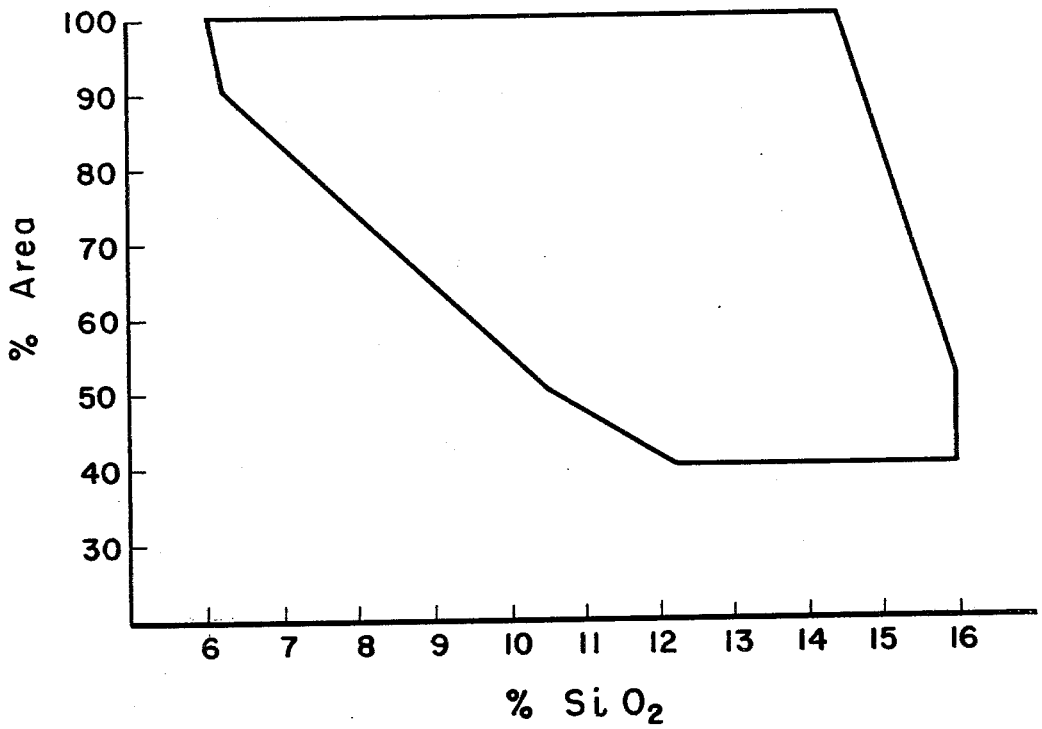
FIG. 5 is a rectangular plot depicting the interrelationship between the ranges of $SiO_2$ concentration and area coverage for the process involving a single coating step.
Figure 7:
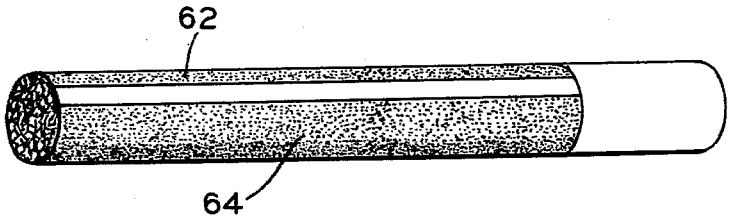
FIG. 7 is a perspective view of another version of a cigarette having a partial silicate coating in accordance with the invention.
Figure 8:
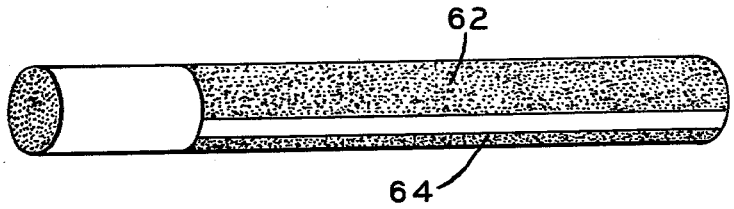
FIG. 8 is a rear perspective view of the cigarette of FIG. 7.

In any chosen three millimeter section along the axial length of the cigarettes of FIGS. 4, 7 and 8, at least in the smokable portion thereof (from the tip to within about three or four millimeters of the filter), the silicate coating covers an area of between 40 and 100% of the total area of the section. The interrelationship between the area of coverage and the silica concentration is depicted in FIG. 5. As shown in FIG. 5, where the cigarette paper is fully coated, the silica concentration ranges from about 6% to 14.5%. As the percentage of area coated decreases, the minimum silica concentration increases, as does the maximum silica concentration so that, at 40% coverage, the minimum silica concentration is 12.2%, and the maximum silica concentration is 16%. Slight variations in the ranges depicted in FIG. 5 will occur as a result of variations in burning rate, which is related to the cigarette diameter, the tobacco composition, the paper composition, and various other factors including the amount of silicate solution applied in excess of that necessary to moisten the side of the paper opposite the roller. However, these variations are minor and do not result in appreciable departures from the ranges of area and silica concentration shown in FIG. 5.

While partial coverage of the paper is most easily accomplished by the application of longitudinal lines of coating, as shown in FIGS. 4, 7 and 8, various alternative coating patterns such as helical patterns, dots, or rings can be used. In any event, it is important that there be no large uncoated areas.

Figure 3:
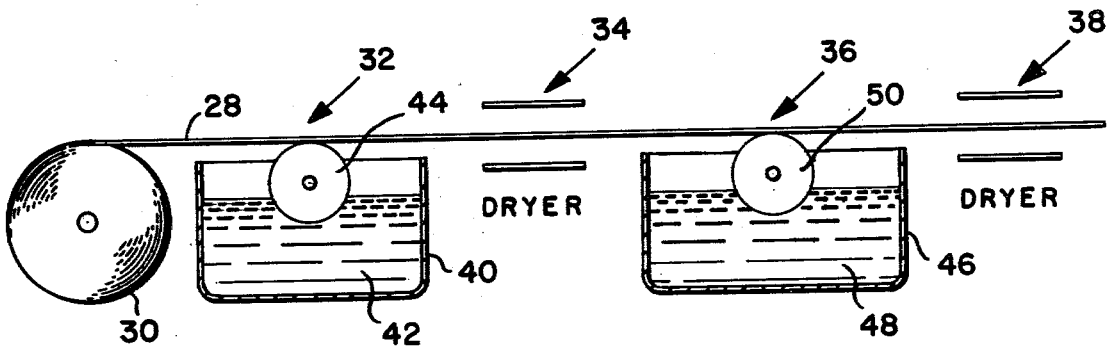
FIG. 3 is a schematic diagram of an apparatus for applying two separate silicate coatings in accordance with an alternative method.

The apparatus of FIG. 3 is used to carry out a coating process involving two coating steps. Paper 28 is fed from roll 30 over a first coater 32, through a first dryer 34, over a second coater 36, and through a second dryer 38. Both coaters are substantially identical in structure and operation to the coater of FIG. 1. The first coater comprises a vessel 40 containing a silicate bath 42, which is applied by means of an application roller 44. The second coater 36 comprises a vessel 46 containing a silicate bath 48, which is applied by means of a roller 50.

Figure 6:
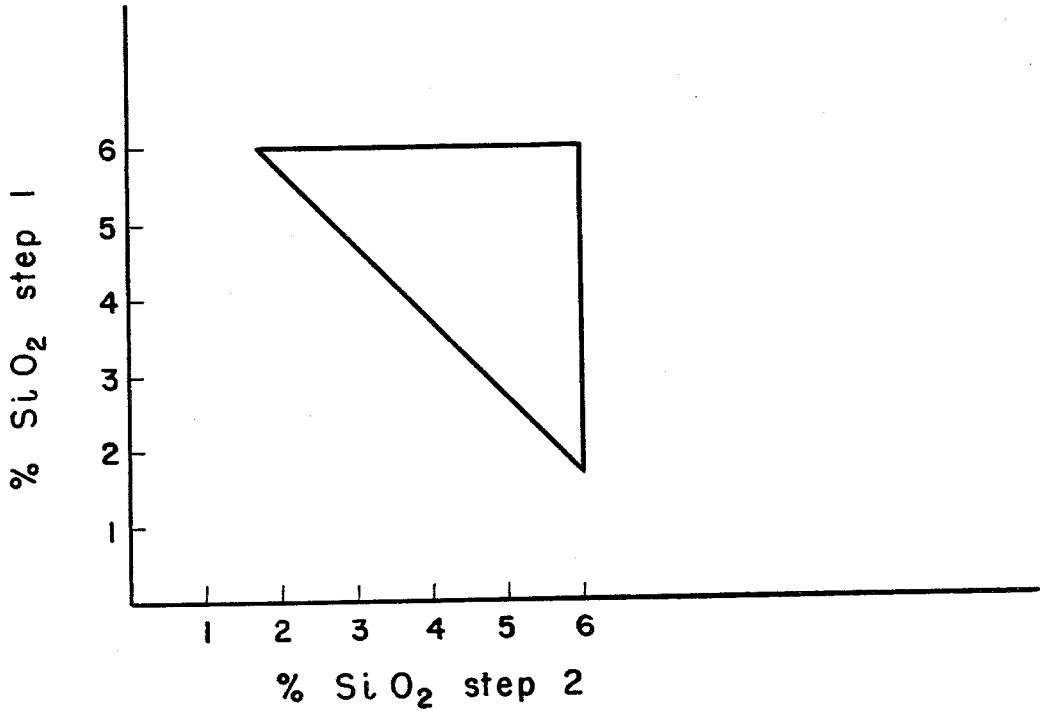
FIG. 6 is a rectangular plot depicting the interrelationship between the ranges of $SiO_2$ concentration in the respective steps of the process involving two sequential coating steps.

The apparatus of FIG. 3 produces a cigarette paper having a uniform silicate coating. The concentrations of the respective baths 42 and 48 are interrelated, as shown in FIG. 6, so that, if the silica concentration in the first step is 6%, the silica concentration in the second step can range from about 1.7 to about 6%. As the silica concentration in the first step decreases, however, the minimum silica concentration in the second step increases so that the minimum concentrations in the respective steps total 7.7%. The maximum silica concentration in either step is 6%, and concentrations of 6% can be used in both steps, if desired.

The advantage of the two step process, depicted in FIGS. 3 and 6, is that it permits lower concentrations of silicate to be used in the coating baths with the result that the coated cigarette paper is more flexible and has a better appearance than paper coated by the single step coating process of FIG. 1.

Cigarettes manufactured in accordance with either of the two methods just described, are capable of satisfying a fire safety test derived from the Federal Flammability Standards for Mattresses set forth in the Federal Register, Volume 37, No. 110—Wednesday, June 7, 1972. The test is carried out as follows. The cigarette is lit and permitted to smolder for one minute. It is then placed on the mattress until it self-extinguishes, or until it is fully consumed without igniting the mattress. After each self-extinguishment, the protective ash residue is removed, the cigarette is relit, and is permitted to smolder for one minute, after which it is again placed on the mattress, a new area of the circumference of the cigarette being placed in contact with the mattress after each self-extinguishment. This procedure is repeated until the cigarette is fully consumed.

If the cigarette ignites the mattress at any time during the test, it fails the test. If, however, the cigarette is either fully consumed without igniting the mattress, or self-extinguishes two or more times, and does not ignite the mattress, it is considered to pass the fire test.

The cigarette must also be capable of smoldering for a full minute between puffs. That is, it must not self-extinguish, when held in a horizontal position, and smoked at the rate of one puff per minute.

Cigarettes prepared in accordance with the invention satisfy both of the above requirements, and in addition exhibit satisfactory taste and smoking characteristics. Smoking characteristics are considered satisfactory when the volume and density of the smoke produced by the treated cigarette are substantially the same as the volume and density from the smoke of an untreated cigarette during puffing, but between puffs, the smoke is reduced to almost negligible quantities. The reduction of the quantity of smoke produced between puffs makes the cigarette less objectionable to non-smokers and less hazardous to the health of the smoker. At the same time, it increases the number of puffs available from a given quantity of tobacco, thereby making the cigarette less expensive to produce.

Cigarettes made from paper treated in accordance with the invention exhibit superior ash retention, which contributes to safety by reducing the likelihood of skin contact burns and fires caused by hot ashes falling onto clothing and upholstery. The superior ash retention of cigarettes made in accordance with this invention also contributes to the cleanliness of carpets, clothing and furniture.

The process of the invention is applicable to conventional cigarettes of various types, including the so-called "little cigars," and to cigarettes having various cross-sectional shapes other than circular. It is also applicable to cigarettes having circumferences differing from the conventional 25 mm. circumference, and to cigarettes containing tobacco substitutes either along with tobacco or instead of tobacco.

I claim:

1. The process of making a cigarette comprising the steps of soaking at least part of the surface of the paper thereof with an aqueous alkali metal silicate solution to impart a coating to the paper, and thereafter allowing the coated paper to dry, and forming the paper into a cylinder to produce a cigarette wrapper, wherein the $SiO_2$ concentration by weight in the coating solution, and the coated area of said surface in any selected three millimeter long section of said cylinder are substantially within the boundaries of an area, on a rectangular plot, defined by straight lines joining the points 100, 6; 100, 14.5; 52, 16; 40, 16; 40, 12.2; 50, 10.5; and 90, 6.2, wherein the first number of each pair is the percentage ratio of the coated area to the total area, and the second number is the percentage of $SiO_2$ in the silicate solution by weight.

2. The process of treating cigarette paper comprising the sequential steps of soaking substantially the entire surface of said paper with an aqueous alkali metal silicate solution to impart a first coating to the paper, allowing the coated paper to dry, and soaking substantially the entire surface of said paper with an aqueous alkali metal silicate solution to impart a second coating to the paper, the concentrations of $SiO_2$ by weight in the respective coating steps being substantially within the boundaries of a triangle, on a rectangular plot, the corners of which triangle are defined by the points 6, 1.7; 6, 6; and 1.7, 6, wherein the first number of each pair is the percentage of $SiO_2$ by weight in the first coating step, and the second number of each pair is the percentage of $SiO_2$ by weight in the solution of the second coating step.

3. The process of making a cigarette in which a paper covering is formed into a cylinder to produce a cigarette wrapper, comprising the step of soaking at least part of the surface of the paper with an aqueous alkali metal silicate solution to impart a coating to the paper, the $SiO_2$ concentration by weight in the coating solution, and the coated area of said surface in any selected three millimeter long section of said cylinder being substantially within the boundaries of an area, on a rectangular plot, defined by straight lines joining the points 100, 6; 100, 14.5; 52, 16; 40, 16; 40, 12.2; 50, 10.5; and 90, 6.2, wherein the first number of each pair is the percentage ratio of the coated area to the total area, and the second number is the percentage of $SiO_2$ in the silicate solution by weight.

* * * * *